United States Patent [19]

Matsubara et al.

[11] 4,009,655

[45] Mar. 1, 1977

[54] PRINT HAMMER ACTUATION DEVICE

[75] Inventors: Toru Matsubara, Chofu; Toshikazu Nakano, Fuchu; Kazuo Nomura, Chofu, all of Japan

[73] Assignee: Tokyo Juki Kogyo Kabushiki Kaisha, Tokyo, Japan

[22] Filed: July 7, 1975

[21] Appl. No.: 593,532

[52] U.S. Cl. ..... 101/93.31

[51] Int. Cl.[2] ..... B41J 9/36

[58] Field of Search ..... 101/93.14, 93.48, 93.28, 101/93.29, 93.30, 93.31, 93.32, 93.34, 93.35

[56] References Cited

UNITED STATES PATENTS

| | | | |
|---|---|---|---|
| 3,648,602 | 3/1972 | Avgerinos et al. | 101/93.31 |
| 3,795,185 | 3/1974 | Shimodaira et al. | 101/93.31 |
| 3,804,009 | 4/1974 | Blume | 101/93.33 |
| 3,823,667 | 7/1974 | Babler | 101/93.31 |
| 3,832,942 | 9/1974 | Murayoshi | 101/93.31 |
| 3,935,813 | 2/1976 | Matsubara | 101/93.31 |

*Primary Examiner*—Edward M. Coven
*Attorney, Agent, or Firm*—Wenderoth, Lind & Ponack

[57] ABSTRACT

A typewriting device includes a type-carrying drum driven from a drive source and supporting types in rows parallel to the axis of the drum. A plurality of electromagnets are associated with the types in rows. A plurality of operation levers are disposed opposite to the magnets and are normally urged away from the magnets. A plurality of actuators are rockably mounted on respective of the operation levers. A plurality of hammer levers are mounted on a common shaft in association with respective of the operation levers for rocking movement about the shaft between the type-carrying drum and the actuators and are normally urged away from the type-carrying drum. The hammer levers are caused to contact the drum with a striking force upon operation of the actuators. A plurality of drive members associated with the hammer levers, are mounted for rotation in synchronization with the type-carrying drum, and each include a cam portion opposite to a respective actuators and a projection separated from the cam portion in parallel to and radially away from the axis of rotation of the drive member.

3 Claims, 1 Drawing Figure

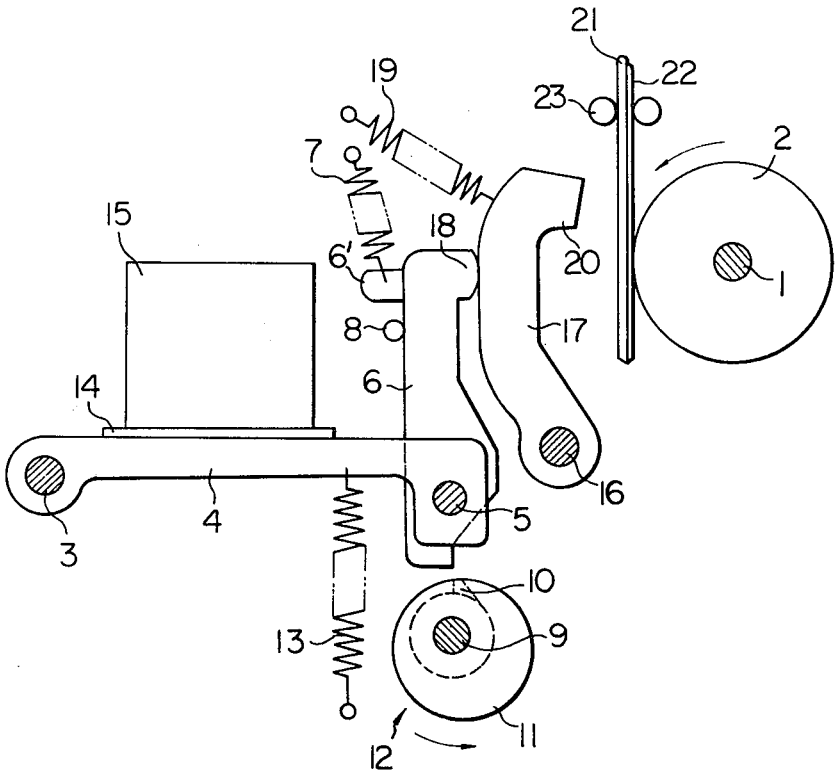
21
22
23
19
2
7
15
18
6'
20
1
8
17
6
14
16
4
5
3
10
13
9
11
12

PRINT HAMMER ACTUATION DEVICE

BACKGROUND OF THE INVENTION

This invention relates to a typewriting device and more particularly, to a typewriting device which can increase typewriting speed, reduce the overall size of the device and reduce the production cost of the device.

There have been proposed and practically employed a great variety of typewriting devices, and in one of the most common typewriting devices, each actuator adapted to deliver a striking force to the type-carrying drum to effect one typewriting operation is pivotally mounted on its associated operation lever which is positioned opposite to and normally held apart from its associated magnet means which is normally held deenergized. When the typewriting device is operated for effecting one typewriting operation, the magnet means is energized to attract the operation lever to the magnet means to move the actuator into the locus of a continuously rotating drive member associated with the actuator to cause the drive member to strike against the moved actuator to thereby effect one typewriting operation through the hammer lever. Therefore, in order to attract the operation lever which is normally held apart from the magnet means when the typewriting device is in its non-operative position, the magnet means is required to have a substantially great magnetic force which results in an increase in the overall size of the device and, accordingly, an increase of the production cost of the device, as well as reduction of typewriting speed.

SUMMARY OF THE INVENTION

Therefore, one object of the present invention is to provide a novel and improved typewriting device which can effectively eliminate the disadvantages inherent in the conventional typewriting devices.

Another object of the present invention is to provide a novel and improved typewriting device in which each operation lever is normally held against its associated magnet means which is maintained energized, but which when the typewriting device is to be operated for typewriting, the operation lever is pivoted away from the magnet means by the magnet means being deenergized, to allow the operation lever to actuate the actuator which in turn actuates the hammer lever to effect one typewriting operation.

The above and other objects and attendant advantages of the present invention will be more readily apparent to those skilled in the art from the following description taken with the accompanying drawing which shows one preferred embodiment of the invention for the purpose of illustration only, but not for limiting the scope of the same in any way.

BRIEF DESCRIPTION OF THE DRAWING

The sole FIGURE of the accompanying drawing is a schematic side elevational view of one preferred embodiment of typewriting device constructed in accordance with the present invention.

DETAILED DESCRIPTION OF PREFERRED EMBODIMENT OF THE INVENTION

The present invention will be now described referring to the accompanying drawing which schematically shows one preferred embodiment of a typewriting device of the invention. In the sole FIGURE of the drawing, reference numeral 1 denotes a transverse drive shaft which is suitably journalled at the opposite ends thereof in the machine frame (not shown) and continuously rotated from a conventional drive source (not shown), and a type-carrying drum 2 is coaxially disposed about the drive shaft for rotation therewith. The type-carrying drum 2 supports thereon a plurality of rows of types (not shown) arranged in parallel to the axes of the drive shaft 1 and drum 2. A second transverse shaft 3 is suitably secured at the opposite ends thereof in the machine frame (not shown) and extends in a plane which is parallel to and below the plane in which the drive shaft 1 extends. An operation lever 4 is pivoted at one end thereof (the left-hand end as seen in the FIGURE) to the shaft 3 and has a pin 5 fixedly secured to and laterally projecting from the other end (the right-hand end as seen in the FIGURE) of the lever. The pin 5 pivotally supports the lower end of an actuator 6 which has at the upper end thereof an anchoring lug 6' extending laterally of the actuator. The actuator 6 also has a lug 18 at the upper end thereof and on the side thereof opposite to the side where the lug 6' is pivoted for a purpose to be described hereinafter. One end of a coiled spring 7 is anchored to the lug 6' with the other end of the spring suitably anchored to the machine frame (not shown) for normally urging the actuator 6 about the pin 5 in the counterclockwise direction as seen in the FIGURE. A stop 8 is suitably secured to the machine frame (not shown) in a position adjacent to the left-hand side of the actuator 6 and transversely extends from the machine frame so as to limit the movement of the actuator 6 in the counterclockwise direction (as seen in the FIGURE). A transverse third shaft 9 is suitably journalled at the opposite ends thereof in the machine frame (not shown) and extends parallel to the shafts 1 and 3 in a position below the actuator 6. The shaft 9 is continuously driven from a suitable drive source (not shown) which is common to the shaft 1 and eccentrically supports a cylindrical actuator drive member 12 thereabout. The member 12 integrally includes a smaller diameter portion concentric with shaft 9 and having a projection 10 and an eccentric larger diameter portion having an eccentric camming section 11. The projection 10 and camming section 11 are diametrically opposite to each other. A coiled spring 13 is anchored at one end thereof to an intermediate point between the opposite ends of the operation lever 4, and the other end of the spring is suitably secured to the machine frame (not shown) so as to normally urge the operation lever 4 into contact with the outer periphery of the larger diameter portion of the actuator drive member 12. When the operation lever 4 is in contact with the outer periphery of the larger diameter portion of the actuator drive member 12, the lower end of the actuator 6 is positioned within the locus of the rotational movement of the projection 10 of the smaller diameter portion of the actuator drive member 12. A suitable magnetic member 14 is mounted on the upper surface of the operation lever 4 between the opposite ends of the lever and a suitable electromagnet 15 is mounted on a suitable support part of the machine frame (not shown) above and adjacent to the magnetic member 14 in such an arrangement that when the operation lever 4 is rotated by the member 12 in the counter-clockwise direction as seen in the FIGURE against the force of the coiled spring 13 and the electromagnet 15 is energized, the electromagnet 15 attracts the magnetic member 14 to the magnet and accordingly, the operation lever 4 on which the magnetic member 14 is mounted is attracted to the magnet in its energized condition. For this purpose, the force of the coiled spring 13 is set to be weaker than the magnetic force of the electromagnet 15, but stronger than the force of the coiled spring 7. On the other hand, when the electromagnet 15 is deenergized to allow the operation lever 4 to be pivoted in th clockwise direction (as seen in the FIGURE) by the action of the coiled spring 13, the lower end of the actuator 6 which is normally positioned out of the locus of the rotation movement of the projection 10 on the actuator drive member 12 moves into the locus of the rotational movement of the projection 10. The electromagnet 15 is supplied with electric current from a suitable electric source (not shown). Disposed between the actuator 6 and type-carrying drum 2 is a fourth transverse shaft 16 which is suitably secured at the opposite ends thereof to the machine frame (not shown) and extends parallel to the shafts 1, 3 and 9, and a hammer lever 17 is pivoted at the lower end thereof to the shaft 16. The upper end of the hammer lever 17 has one end of a coiled spring 19 secured thereto, and the other end of the coiled spring is suitably secured to the machine frame (not shown) so as to normally urge the hammer lever 17 in the counter-clockwise direction as seen in the FIGURE against the actuator 6. The hammer lever 17 has a lug 20 at the upper end thereof on the side opposite from the side where the spring 19 is secured, and the lug 20 serves as a striking means which strikes against a selected type in a selected row of the plurality of type rows carried on the type-carrying drum 2. A paper-ribbon feed mechanism 23 is provided on the machine frame (not shown) between the type-carrying drum 2 and hammer lever 17, and the mechanism is intermittently driven from a suitable drive source (not shown) so as to feed a paper 21 and an inked ribbon 22 arranged in side-by-side relationship in a vertical path defined closely adjacent to the periphery of the type-carrying drum 2.

Although only one operation lever 4 and only one hammer lever 17 have been shown and described hereinabove, it is to be noted that a plurality of similar operation lever and actuator units 4, 6 are pivoted at one end to the common transverse shaft 3 in laterally spaced relationship to each other, and that similarly, a plurality of similar hammer levers 17 are pivoted at the lower ends thereof to the common transverse shaft 16 in laterally spaced relationship to each other. It is also noted that a plurality of similar drive members 12, of a number corresponding to the number of operation levers 4, are eccentrically secured to the common transverse shaft 9 in laterally spaced relationship to each other in opposition to the respective operation levers 4, respectively. Furthermore, a plurality of similar electromagnets 15 are provided in association with the respective operation levers 4, respectively.

With the above-mentioned construction and arrangement of the parts of the typewriting device of the invention, as mentioned hereinabove, since the transverse shaft 9 and type-carrying drum 2 are continuously driven from the common drive source (not shown) in the directions shown by the arrows as seen in the FIGURE, and the electromagnets 15 are also maintained in their energized condition while the typewriting device of the invention is in its position waiting for typewriting operation, in such a position of the device, the right-hand ends of the operation levers 4 (as seen in the drawing) having the magnetic members 14 which are to be attracted by the respectively associated magnets 15 are positioned out of the loci of the projections 10 of the drive members 12, and the striking lugs 20 on the hammer levers 17 are urged about the common shaft 16 in the counter-clockwise direction away from the type-carrying drum 2 to the neutral position in which the hammer levers 17 are positioned substantially vertically.

When the typewriting device of the invention is desired to be operated for typewriting a selected letter, a key (not shown) associated with the type which carries the selected letter is pushed to deenergize the electromagnet 15 associated with the pushed key just before the type preceding the selected letter-carrying type passes by the position in which the preceding type confronts the striking lug 20 on the hammer lever 17 associated with the selected type whereupon the operation lever 4 associated with the selected type is urged to pivot about the shaft 4 in the clockwise direction as seen in the FIGURE by the force of the associated spring 13 to thereby cause the lower end of the operation lever 4 to contact the outer periphery of the larger diameter portion of the associated drive member 12 which is continuously rotating and simultaneously, brings the lower end of the associated actuator 6 into the locus of the rotational movement of the projection 10 on the smaller diameter portion of the rotating drive member 12. When the lower end of the actuator 6 enters the locus of rotational movement of the projection 10 on the rotating drive member 12 as mentioned hereinabove, the projection 10 strikes against the lower end of the actuator 6 to urge the actuator 6 to pivot about the pin 5 on the associated operation lever 4 in the clockwise direction as seen in the FIGURE against the force of the coiled spring 7 associated with the actuator 6, whereupon the striking lug 18 on the hammer lever actuator 6 suddenly pushes the hammer lever 17 at an intermediate point between the opposite ends thereof toward the type-carrying drum 2 to cause the hammer lever 17 to pivot about the shaft 16 in the clockwise direction (as seen in the FIGURE) against the force of the spring 19 associated with the pivoting hammer lever 17. As the hammer lever 17 pivots in the manner mentioned just above, the striking lug 20 on the lever 17 strikes against the selected letter-carrying type on the drum 2 through the paper 21 and ribbon 22 which are held stationary in the path between the hammer lever and drum to thereby effect a typing on the paper 21. While the typewriting operation is being effected, the intermittently driven feed mechanism is stopped and accordingly, the paper and ribbon 21 and 22 remain stationary.

When electric current is supplied to the electromagnet 15 associated with the key relating to the type supporting a desired letter just before the completion of the peceding typewriting operation, the operation lever 4, the right-hand end of which (as seen in the FIGURE) contacts the outer periphery of the larger diameter portion of the drive member 12, which is actuated when the typwriting operation for the desired letter is effected is urged to pivot about the shaft 3 by the eccentric cam section 11 on the drive member 12 whereupon the now energized electromagnet 15 attracts the operation lever by means of the magnetic member 14 mounted on the lever.

As is clear from the foregoing description in connection with one preferred embodiment of the invention, when the electromagnet 15 associated with the type supporting a letter desired to be typed is deenergized, the lower end of the respective actuator 6, which is normally positioned out of the locus of the rotational movement of the projection 10 on the associated rotating drive member 12, is rapidly brought into the rotational movement locus of the projection 10 by the action of the spring 13 associated with the actuator and the projection 10 on the rotating drive member 12 in turn causes the striking lug 18 on the actuator 6 to strike against the associated hammer lever 17 which in turn delivers the striking force by means of its striking lug 20 to the type supporting the desired letter with the paper and ribbon positioned therebetween. Thus, the typewriting device of the invention can effect the typewriting operation at a faster speed as compared with the conventional typewriting device in which the typewriting operation is effected by means of a member which is attracted by an electromagnet when the latter is energized. And since each of the drive members which are secured to the common normally rotating shaft integrally includes a projection adapted to deliver a striking force to the associated hammer lever and a cam section adapted to return the operation lever to the electromagnet after the operation lever has been separated from the electromagnet, the number of parts of the typewriting device can be reduced as compared with the conventional typewriting device to thereby simplify the mechanism. Furthermore, since the operation lever is caused to approach the electromagnet by the cam section on the drive member, the electromagnet adapted to attract the operation lever may be an electromagnet having a relatively low magnetic force which contributes to a reduction in the overall size of the typewriting device.

In the foregoing, although description has been made of the typewriting device in which when the electromagnet is deenergized, the associated operation lever is separated from the deenergized electromagnet to effect the typewriting operation, instead a permanent magnet can be employed in place of the electromagnet and a coil would about the permanent magnet maybe supplied with electric current to demagnetize the magnet to obtain the same effect.

In the foregoing, description has been made of one preferred embodiment of the invention, but it will readily occur to those skilled in the art that the same is illustrative in nature, and does not limit the scope of the invention in any way. The scope of the invention is only limited by the appended claims.

What is claimed is:

1. A typewriting device comprising:

a continuously driven type carrying drum;

a plurality of hammer levers pivotally mounted about an axis parallel to the axis of said drum, each said hammer lever having a lug thereon;

a plurality, equal in number to the number of said hammer levers, of operation levers pivotally mounted about an axis parallel to the axis of said drum;

a plurality of actuators, one each pivotally mounted on a respective one of said operation levers, each said actuator having a lug contacting a respective one of said hammer levers;

a plurality of normally energized magnet means, one each mounted adjacent a respective one of said operation levers, for normally urging said operation levers into magnetically attracted inoperative positions, each said magnet means being selectively deenergizable for a typing operation;

a plurality of drive members, one each positioned adjacent a respective one of said operation levers and a respective one of said actuators, said drive members being continuously driven in synchronization with said drum about an axis parallel to the axis of said drum;

a plurality of biasing means, one each connected to a respective one of said operation levers, for urging each said operation lever from said inoperative position thereof to an operative position thereof away from the respective said magnet means when said magnet means is deenergized;

each said drive member having thereon projection means for striking a respective actuator to pivot said actuator about the axis thereof when the respective said operation lever is in the respective said operative position, for causing said actuator lug to pivot the respective said hammer lever about the axis thereof, and for thereby causing said hammer lever lug to strike a type on said drum to complete a typing operation; and each said drive member having thereon cam means, eccentric with respect to said drive member axis, for moving the respective said operation lever against the respective said biasing means from said operative position thereof back toward the respective said magnet means, whereby said magnet means upon being energized after completion of a typing operation moves said operation lever back to said inoperative position thereof.

2. A typewriting device as claimed in claim 1, wherein each of said operation levers has thereon a magnetically attractable member.

3. A typewriting device as claimed in claim 1, wherein said operation levers are each pivoted at one end thereof to a common shaft, said operation levers being spaced from each other axially of said shaft.

* * * * *